US005183024A

United States Patent [19]

Morita et al.

[11] Patent Number: 5,183,024

[45] Date of Patent: Feb. 2, 1993

[54] IGNITION DEVICE FOR INTERNAL COMBUSTION ENGINE

[75] Inventors: Shingo Morita; Mitsuru Koiwa, both of Himeji, Japan

[73] Assignee: Mitsubishi Denki Kabushiki Kaisha, Tokyo, Japan

[21] Appl. No.: 769,318

[22] Filed: Oct. 1, 1991

[30] Foreign Application Priority Data

Oct. 4, 1990 [JP] Japan ..... 2-265121
Oct. 4, 1990 [JP] Japan ..... 2-265122
Oct. 5, 1990 [JP] Japan ..... 2-266357

[51] Int. Cl.[5] ..... F02P 3/08

[52] U.S. Cl. ..... 123/598; 123/605; 123/620

[58] Field of Search ..... 123/598, 604, 605, 620, 123/656

[56] References Cited

U.S. PATENT DOCUMENTS 3,838,328 9/1974 Lundy ..... 123/598 X
4,688,538 8/1987 Ward et al. ..... 123/598
4,696,280 9/1987 Niggemeyer ..... 123/598
5,074,274 12/1991 Okuda ..... 123/604

FOREIGN PATENT DOCUMENTS 51953 12/1978 Japan .
38663 3/1982 Japan .
140470 8/1983 Japan .

*Primary Examiner*—Tony M. Argenbright
*Attorney, Agent, or Firm*—Sughrue, Mion, Zinn, Macpeak and Seas

[57] ABSTRACT

An ignition device for an internal combustion engine including: a DC power source; a convertor for raising the voltage of the DC power source to a predetermined voltage; a charge storing device arranged to be charged with the output from the convertor; an ignition coil; an ignition signal generator for generating an ignition signal in synchronization with the rotation of the internal combustion engine; a switch which is switched on in response to the ignition signal generated by the ignition signal generator to discharge a charge stored in the charge storing device through the ignition coil; and a controller for stopping the operation of the convertor during a period in which the ignition signal is being transmitted from the ignition signal generator.

14 Claims, 9 Drawing Sheets

IGNITION DEVICE FOR INTERNAL COMBUSTION ENGINE

BACKGROUND OF THE INVENTION

1. Field of the Invention

The present invention relates to a condenser-discharge type ignition device for an internal combustion engine.

2. Description of the Related Art

FIG. 6 illustrates a conventional ignition device for an internal combustion engine. Referring to FIG. 6, a drive circuit 3 is connected to an oscillating circuit 2. A transistor 4 serving as a first switching device is connected to the drive circuit 3. An end portion of the primary coil of a transformer is connected to the collector of the transistor 4. The above-described oscillating circuit 2, the drive circuit 3, the transistor 4 and the transformer 5 constitute a DC-DC converter. A rectifying diode 6 is connected to the secondary coil of the transformer 5. A capacitor 8 is connected between the cathode of the rectifying diode 6 and ground. An end portion of the primary coil of an ignition coil 10 is connected to a junction between the cathode of the rectifying diode 6 and the capacitor 8. Furthermore, a thyristor 11 serving as a second switching device is connected to a portion between another end portion of the primary coil of the ignition coil 10 and the ground. Furthermore, an ignition plug 15 is connected to the secondary coil of the ignition coil 10.

A trigger circuit 17 for generating a trigger signal in response to ignition signal $S_2$ is connected to an ignition signal generating circuit 16 which generates the ignition signal $S_2$ in synchronization with the internal combustion engine. The trigger circuit 17 is connected to the gate terminal of the thyristor 11. A battery 1 is connected to the oscillating circuit 2, the drive circuit 3, another terminal of the primary coil of the transformer 5, the ignition signal generating circuit 16 and the trigger circuit 17.

Then, the operation of the above-described conventional ignition device will now be described. As shown in FIG. 7, the drive circuit 3 transmits a drive signal to the transistor 4 in response to signal $S_1$ transmitted from the oscillating circuit 2. As a result, the transistor 4 is driven so that the transformer 5 is electrically turned on/off. At this time, primary current $I_1$ generated in the primary coil of the transformer 5 is 7 converted into secondary current $I_2$ of the transformer 5 so that the capacitor 8 is charged via the diode 6. The capacitor 8 is charged to a voltage level of $V_1$ as shown in FIG. 7.

The ignition signal generating circuit 16 generates the ignition signal $S_2$ in synchronization with the ignition timing of the internal combustion engine. In response to the ignition signal $S_2$ thus-generated, the trigger circuit 17 transmits the trigger signal to the gate terminal of the thyristor 11. When the thyristor 11 is thus-triggered, the charge, which has been stored in the capacitor 8, is discharged via the primary coil of the ignition coil 10 and the thyristor 11. At this time, discharge current $I_4$ as shown in FIG. 7 is introduced into the thyristor 11 from the capacitor 8. As a result, high voltage is generated in the secondary coil of the ignition coil 10 so that the ignition plug 15 is ignited.

However, if the secondary current $I_2$ flows in the secondary coil of the transformer 5 when the discharge current $I_4$ is introduced into the thyristor 11 from the capacitor 8, the secondary current $I_2$ of the transformer 5 is as well introduced into the thyristor 11 via the diode 6 and the primary coil of the ignition coil 10. That is, total current $I_5$ passing through the thyristor 11 is the sum of the discharge current $I_4$ from the capacitor 8 and the secondary current $I_2$ of the transformer 5.

Therefore, although the total current $I_5$ does not exceed a predetermined value in a case where the timing at which the thyristor 11 is electrically turned on is, as shown in FIG. 7, different from the timing at which the transformer 5 generates the secondary current $I_2$ as at time $t_1$ and $t_3$, the total current $I_5$ is excessively enlarged in a case where the timing at which the thyristor 11 is electrically turned on coincides with the timing at which the transformer 5 generates the secondary current $I_2$ as at time $t_2$. As a result, there arises a problem that the overall apparatus size and the cost cannot be reduced because the electric current capacity of the thyristor 11 cannot be reduced in order to protect the thyristor 11 from breakage.

FIG. 8 illustrates the structure of another conventional ignition device for an internal combustion engine. The ignition device of this type further comprises, in addition to the elements of the ignition device shown in FIG. 6, a second rectifying diode 7 connected to the secondary coil of the transformer 5. Furthermore, a second capacitor 9 is connected to a portion between the cathode of the rectifying diode 7 and the ground. In addition, a pulsating current preventing diode 12 is, in parallel, connected to the primary coil of the ignition coil 10. An inductor 13 for maintaining discharge time is connected to a portion between the cathodes of the diodes 7 and 12. Furthermore, a diode 14 for maintaining the discharge time is connected to a portion between the cathode of the diode 7 and the anode of the diode 12. The remaining elements are the same as those for the ignition device shown in FIG. 6.

The operation of the ignition device of this type will now be described. Similarly to the ignition device shown in FIG. 6, the second capacitor 9 is also charged via the diode 7 at the same time at which the capacitor 8 is charged. In this case, the capacitor 9 is charged with a voltage level of $V_2$ as shown in FIG. 9.

The ignition signal generating circuit 16 generates ignition signal $S_2$ at the ignition timing of the internal combustion engine. In response to the ignition signal $S_2$, a trigger signal is transmitted from the trigger circuit 17 to the gate terminal of the thyristor 11. When the thyristor 11 is triggered, the charge, which has been stored in the capacitor 8, is discharged via the primary coil of the ignition coil 10 and the thyristor 11. On the other hand, the charge stored in the capacitor 9 is discharged via the inductor 13, the primary coil of the ignition coil 10 and the thyristor 11. As a result, output voltage $V_3$ and output current $I_3$ as shown in FIG. 9 are generated in the secondary coil of the ignition coil 10 so that the ignition plug 15 is ignited.

At this time, a discharge maintaining current flows from the primary coil of the ignition coil 10 via the diode 14 and the inductor 13. As a result, the discharge made by the ignition plug 15 is maintained for $\Delta t_1$.

However, if the capacitors 8 and 9 are charged by energy supplied from the DC-DC converter during the above-described time $\Delta t_1$ in which the discharge is maintained as at time $t_4$, the above-described discharge maintaining current is stopped, causing a problem to arise in that the discharge is undesirably temporarily stopped.

Another problem takes place in that the size of the DC-DC converter cannot be reduced because both of the above-described conventional ignition devices similarly employ the transformer 5 in the DC-DC converter. In addition, the charging efficiency of each of the capacitors 8 and 9 deteriorates due to the conversion efficiency of the primary and the secondary sides of the transformer 5.

SUMMARY OF THE INVENTION

Accordingly, an object of the present invention is to provide an ignition device for an internal combustion engine capable of protecting its thyristor from breakage while eliminating a necessity of using a thyristor having a large current capacity.

Another object of the present invention is to provide an ignition device for an internal combustion engine capable of preventing the undesirable stop of discharge during the discharging operation performed by an ignition plug.

Another object of the present invention is to provide an ignition device for an internal combustion engine the size of which can be reduced and which reveals an excellent charging efficiency.

According to one aspect of the present invention, there is provided an ignition device for an internal combustion engine comprising: a DC power source; conversion means for raising the voltage of the DC power source to a predetermined voltage; charge storing means arranged to be charged with the output from the conversion means; an ignition coil; ignition signal generating means for generating an ignition signal in synchronization with the rotation of the internal combustion engine; switching means which is switched on in response to the ignition signal generated by the ignition signal generating means to discharge a charge stored in the charge storing means through the ignition coil; and control means for stopping the operation of the conversion means during a period in which the ignition signal is being transmitted from the ignition signal generating means.

According to another aspect of the present invention, there is provided an ignition device for an internal combustion engine comprising: a DC power source; conversion means for raising the voltage of the DC power source to a predetermined voltage; charge storing means arranged to be charged with the output from the conversion means; an ignition coil; ignition signal generating means for generating an ignition signal in synchronization with the rotation of the internal combustion engine; switching means which is switched on in response to the ignition signal generated by the ignition signal generating means to discharge a charge stored in the charge storing means through the ignition coil; discharge maintaining means for passing a discharge current through the ignition coil for a predetermined time period after the discharge of a charge stored in the charge storing means has been completed; and control means for causing the conversion means to commence its operation in synchronization with the ignition signal generated by the ignition signal generating means.

According to another aspect of the present invention, there is provided an ignition device for an internal combustion engine comprising: a DC power source; a first inductor for raising the voltage of the DC power source to a predetermined voltage; charge storing means arranged to be charged with the voltage raised by the first inductor; an ignition coil; ignition signal generating means for generating an ignition signal in synchronization with the rotation of the internal combustion engine; switching means which is switched on in response to the ignition signal generated by the ignition signal generating means to discharge a charge stored in the charge storing means through the ignition coil; and discharge maintaining means for passing a discharge through the ignition coil for a predetermined time period after the discharge of a charge stored in the charge storing means has been completed, wherein the reference potential of each of the charge storing means and the switching means is taken from the positive electrode of the DC power source.

DESCRIPTION OF THE PREFERRED EMBODIMENTS

Preferred embodiments of the present invention will now be described with reference to the drawings.

Figure 1:
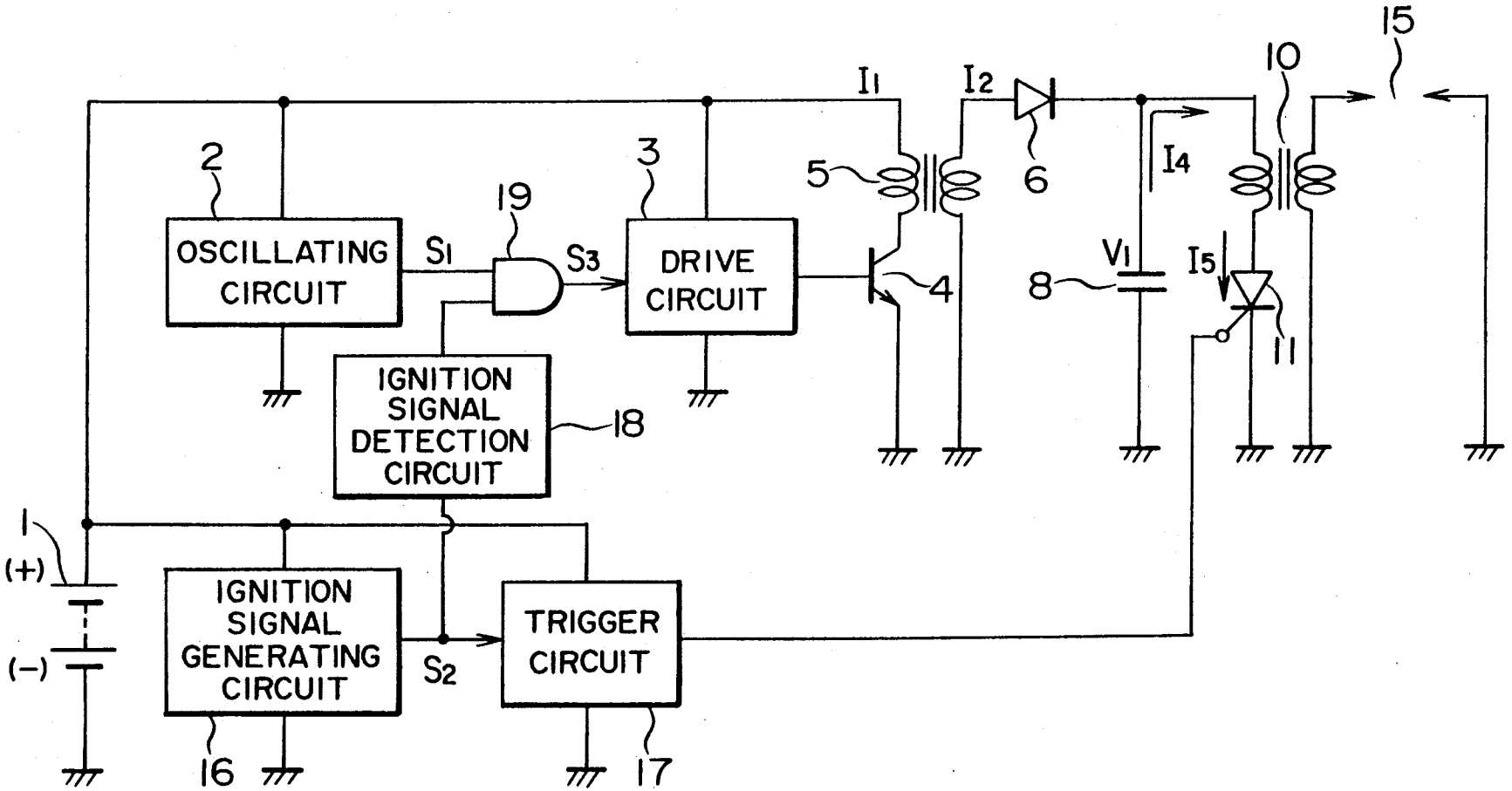
FIG. 1 is a block diagram which illustrates the structure of an ignition device for an internal combustion engine according to a first embodiment of the present invention.

Referring to FIG. 1, a drive circuit 3 is, via an AND or coincidence circuit 19, connected to an oscillating circuit 2. A transistor 4 is connected to the drive circuit 3. An end portion of the primary coil of a transformer 5 is connected to the collector of the transistor 4. A rectifying diode 6 is connected to the secondary coil of the transformer 5. A capacitor 8 is connected to a portion between the cathode of the rectifying diode 6 and the ground. An end portion of the primary coil of an ignition coil 10 is connected to the junction between the cathode of the rectifying diode 6 and the capacitor 8. Furthermore, a thyristor 11 is connected to a portion between another end portion of the primary coil of the ignition coil 10 and the ground. An ignition plug 15 is connected to the secondary coil of the ignition coil 10.

A trigger circuit 17 is connected to an ignition signal generating circuit 16, the trigger circuit 17 further being connected to the gate terminal of the thyristor 11. An ignition signal detection circuit 18 for detecting the output of an ignition signal is connected to the ignition signal generating circuit 16, the output from the ignition signal detection circuit 18 being connected to the AND circuit 19. The AND circuit 19 responds to the output $S_1$ from the oscillating circuit 2 and the output from the ignition signal detection circuit 18 so as to enable or disable the drive circuit 3. A battery 1 is connected to the oscillating circuit 2, the drive circuit 3, another terminal of the primary coil of the transformer 5, the ignition signal generating circuit 16 and the trigger circuit 17.

Figure 6:
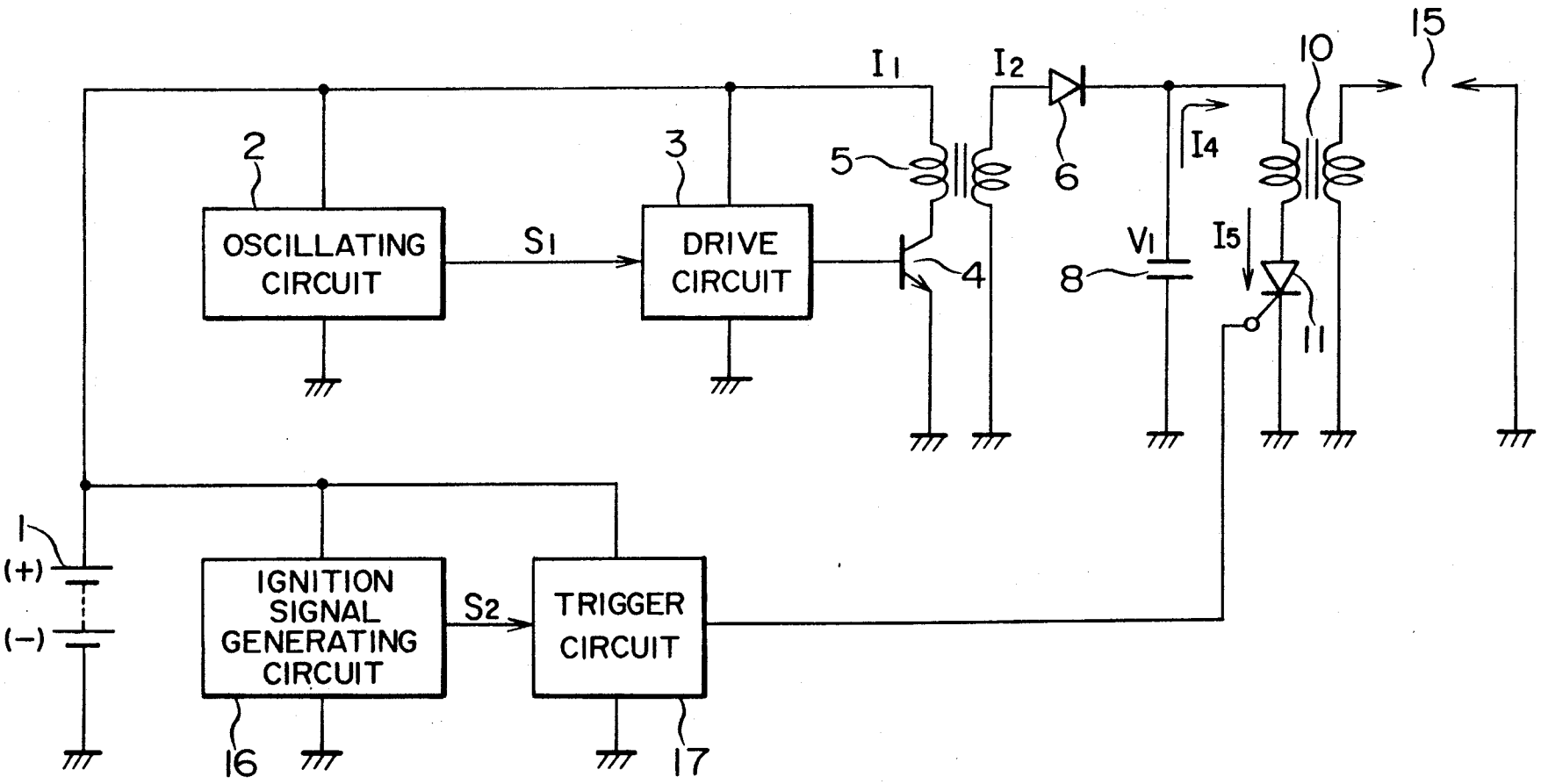
FIG. 6 PRIOR ART
FIG. 6 is a block diagram which illustrates the structure of a conventional ignition device for an internal combustion engine.
Figure 7:
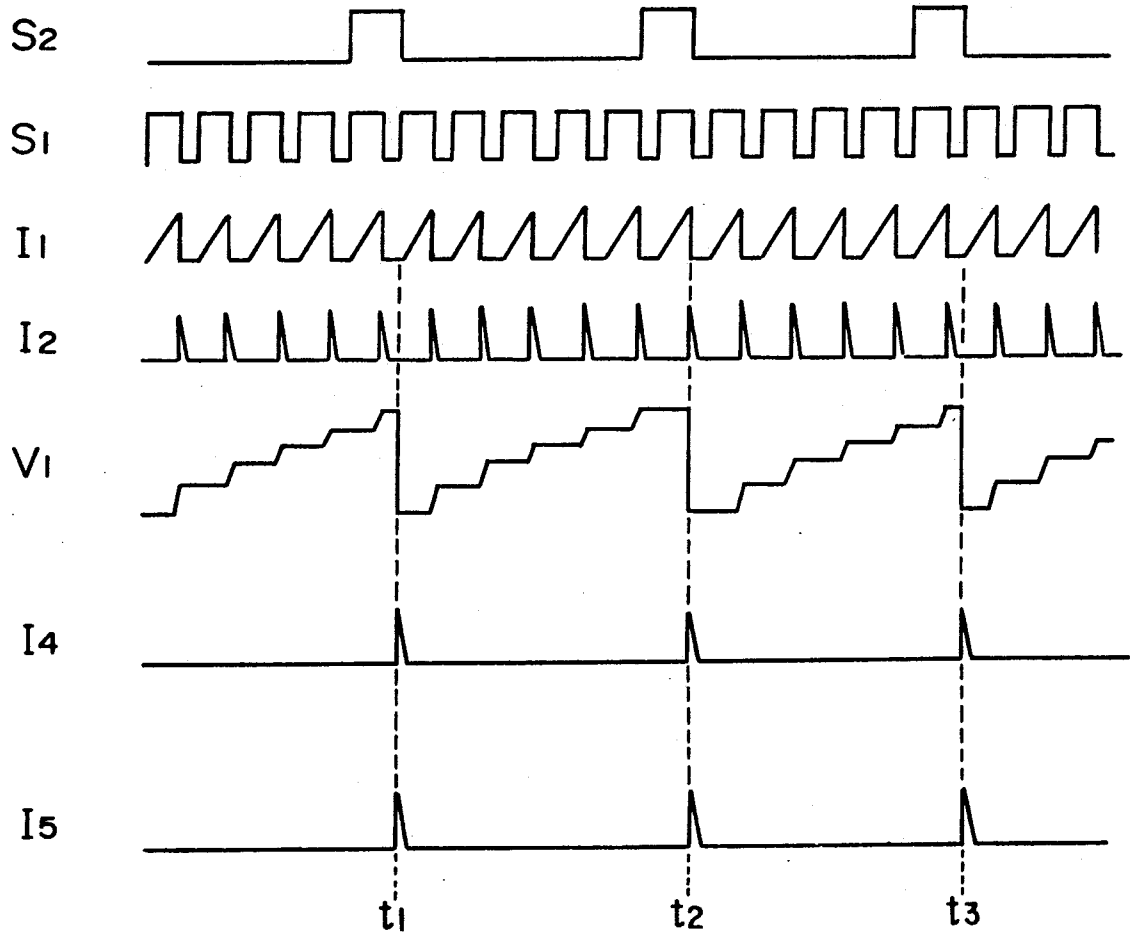
FIG. 7 PRIOR ART
FIG. 7 is a timing chart which illustrates the operation of the device shown in FIG. 6.

That is, the ignition device according to the first embodiment of the present invention is constituted by arranging the conventional ignition device shown in FIG. 6 in such a manner that: the ignition signal detection circuit 18 is connected to the ignition signal generating circuit 16; and the AND circuit 19 is inserted into the portion between the oscillating circuit 2 and the drive circuit 3. As the ignition signal detection circuit 18, an inverter circuit may be, for example, employed.

Figure 2:
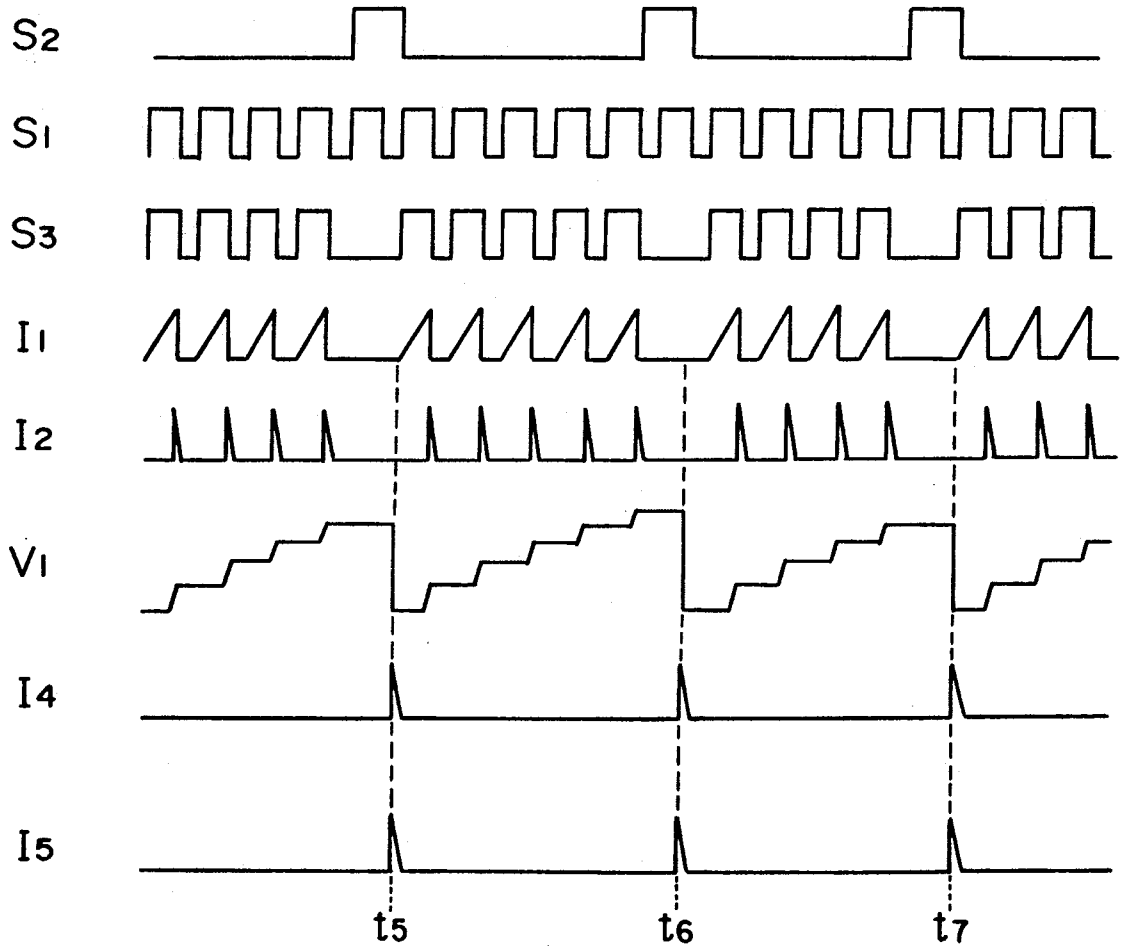
FIG. 2 is a timing chart which illustrates the operation of the first embodiment.

Then, the operation of the first embodiment of the present invention will now be described with reference to a timing chart shown in FIG. 2. In response to the signal $S_1$ transmitted from the oscillating circuit 2, the drive circuit 3 transmits a drive signal to the transistor 4. As a result, the transistor 4 is driven so that the transformer 5 is electrically turned on/off. At this time, primary current $I_1$ generated in the transformer 5 is converted into secondary current $I_2$ of the transformer 5. The secondary current $I_2$ thus-generated as the result of the conversion acts to charge the capacitor 8 to a charging voltage level of $V_1$ shown in FIG. 2 via the diode 6.

The ignition signal generating circuit 16 generates ignition signal $S_2$ in synchronization with the ignition timing of the internal combustion engine. In response to the ignition signal $S_2$, the trigger circuit 17 transmits a trigger signal to the gate terminal of the thyristor 11. When the thyristor 11 is thus-triggered, the charge, which has been stored in the capacitor 8, is discharged via the primary coil of the ignition coil 10 and the thyristor 11. At this time, discharge current $I_4$ is introduced from the capacitor 8 into the thyristor 11 so that high voltage is generated at the secondary coil of the ignition coil 10. As a result, the ignition plug 15 is ignited.

When the ignition signal $S_2$ is generated in the ignition signal generating circuit 16, a detection signal is transmitted from the ignition signal detection circuit 18 to the AND circuit 19. As a result of this, the AND circuit 19 is electrically turned off so that output signal $S_3$ from the AND circuit 19 displays a waveform as shown in FIG. 2. That is, the supply of the output from the AND circuit 19 to the drive circuit 3 is restricted during the period in which the ignition signal $D_2$ is being generated. At this time, the primary current $I_1$ and the secondary current $I_2$ of the transformer 5 are not generated.

Therefore, the secondary current $I_2$ does not pass through the secondary coil of the transformer at times $t_5$, $t_6$ and $t_7$ at each of which the discharge current $I_4$ is introduced into the thyristor 11 from the capacitor 8. Therefore, the total current $I_5$ passing through the thyristor 11 is composed of only the discharge current $I_4$ transmitted from the capacitor 8. As a result, the breakage of the thyristor 11 can be prevented while eliminating the necessity of using a large current capacity thyristor 11.

Figure 3:
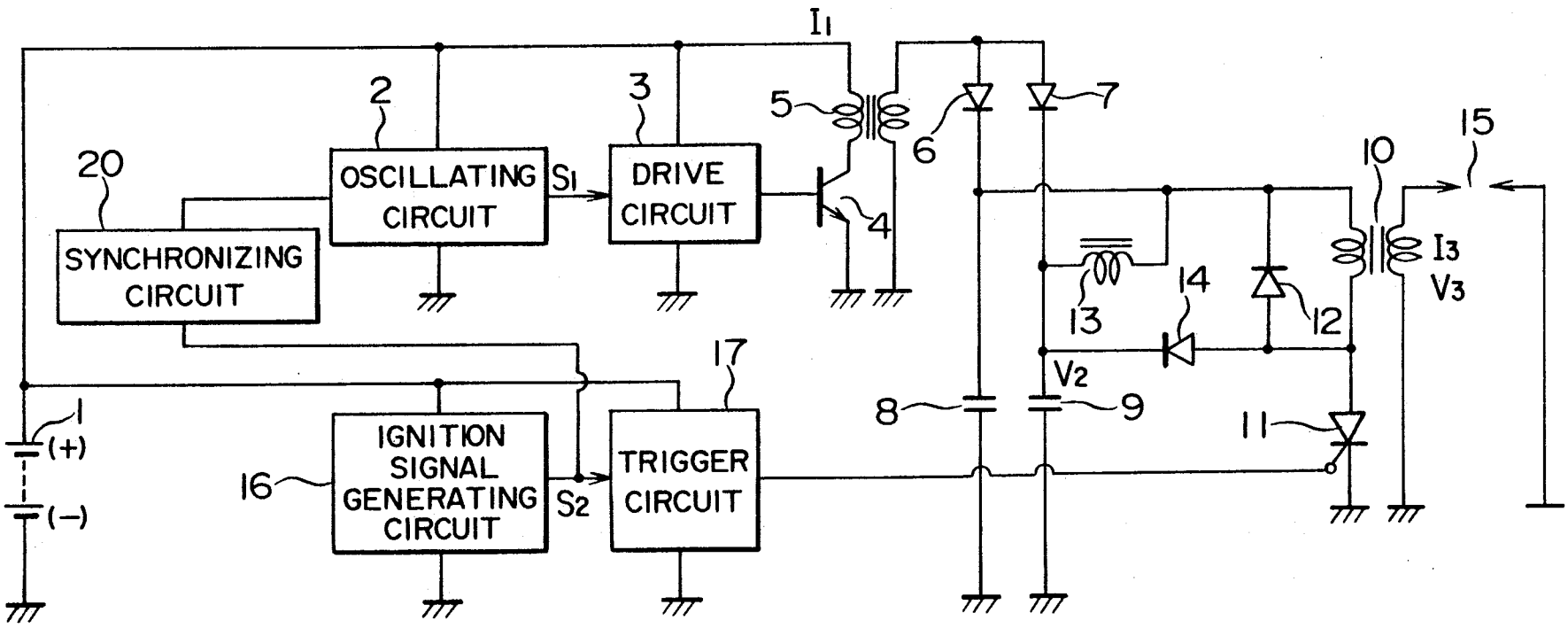
FIG. 3 is a block diagram which illustrates the structure of a second embodiment of the present invention.
Figure 8:
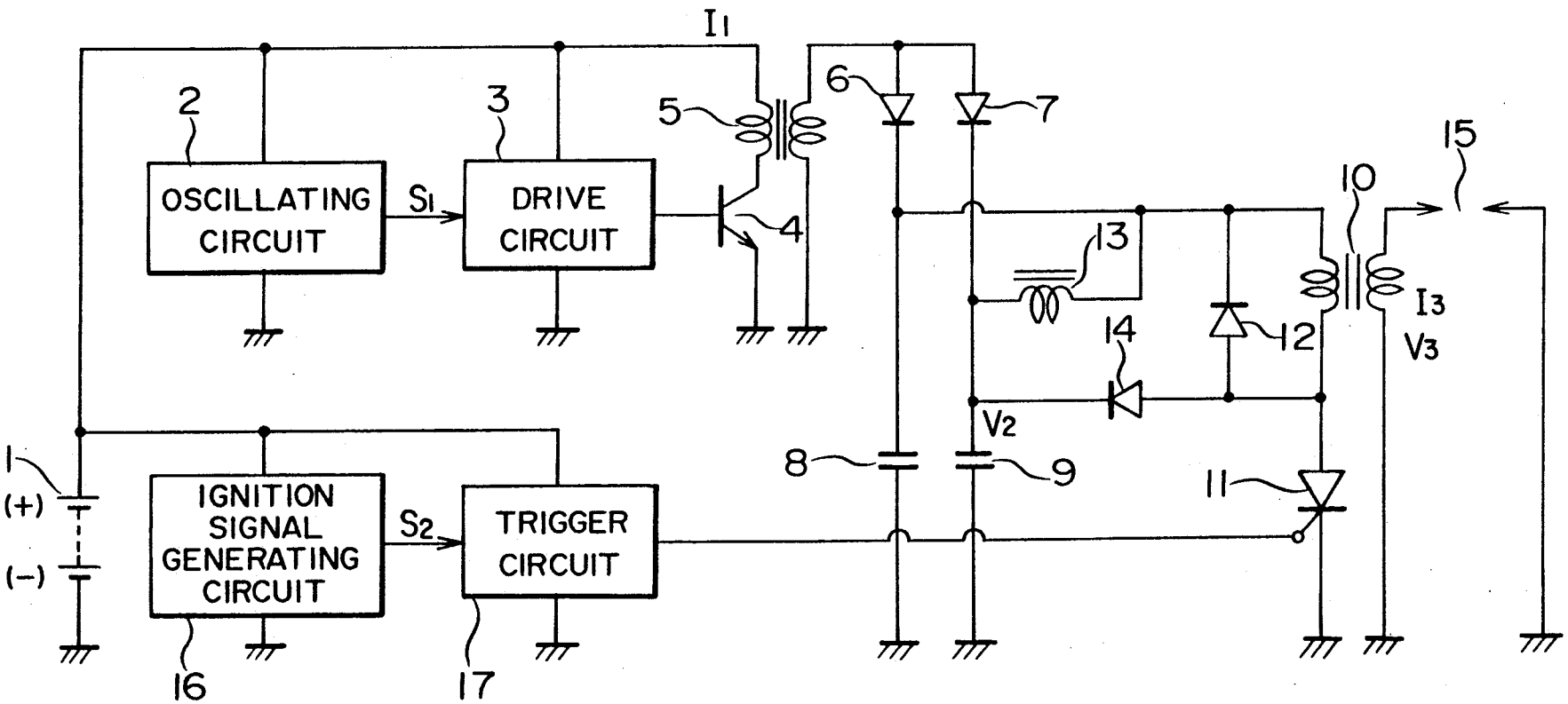
FIG. 8 PRIOR ART
FIG. 8 is a block diagram which illustrates the structure of another conventional ignition device for an internal combustion engine.
Figure 9:
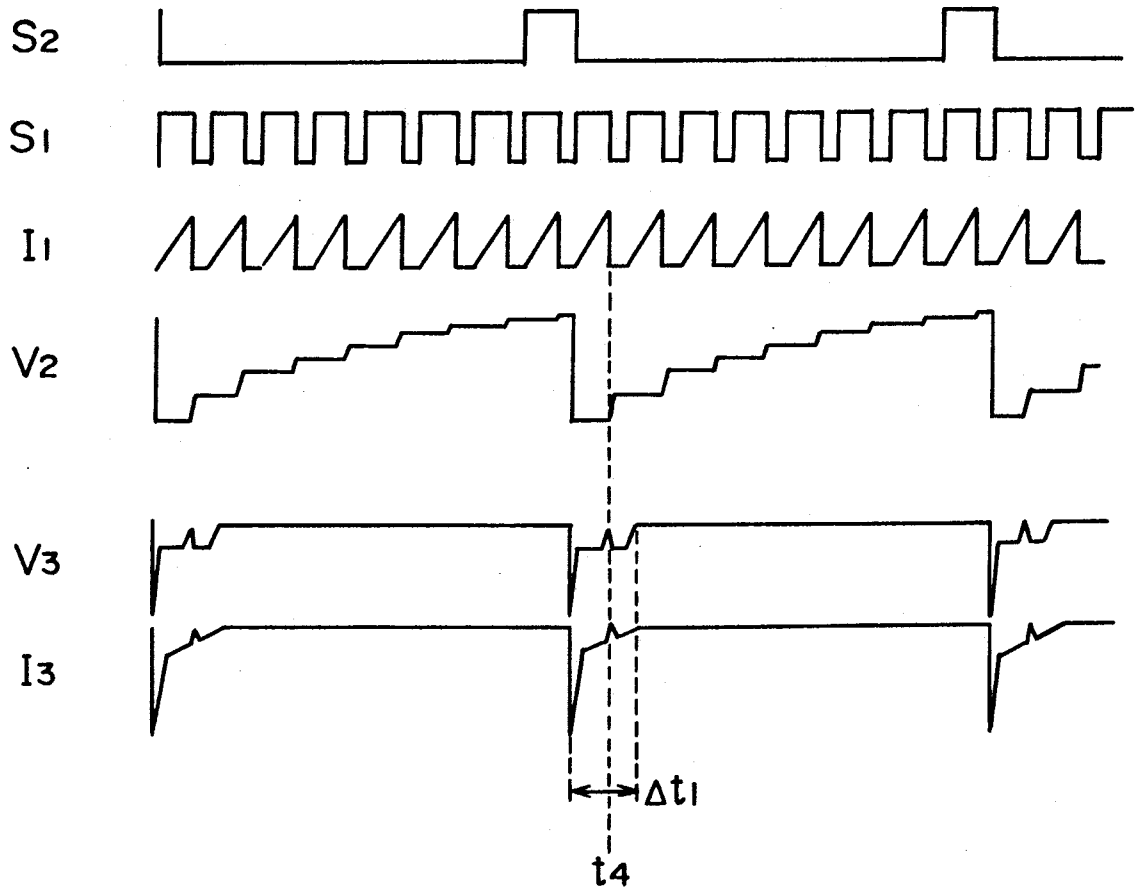
FIG. 9 PRIOR ART
FIG. 9 is a timing chart which illustrates the operation of the device shown in FIG. 8.

A second embodiment of the present invention is shown in FIG. 3. The ignition device for an internal combustion engine according to the second embodiment is constituted by arranging the conventional ignition device shown in FIG. 8 in such a manner that a synchronizing circuit 20 is inserted into a portion between the ignition signal generating circuit 16 and the oscillating circuit 2. The above-described synchronizing circuit 20 causes the oscillating circuit 2 to commence the signal oscillating operation in synchronization with the generation of the ignition signal $S_2$ in the ignition signal generating circuit 16.

Then, the operation of the second embodiment will now be described with reference to a timing chart shown in FIG. 4. In response to signal $S_1$ transmitted from the oscillating circuit 2, the drive circuit 4 transmits a drive signal. As a result, the transistor 4 is driven so that the transformer 5 is electrically turned on/off. At this time, the primary current $I_1$ generated in the primary coil of the transformer 5 is converted into the secondary current $I_2$ of the transformer 5. The secondary current $I_2$ thus-generated as a result of the conversion acts to charge the two capacitors 8 and 9 via the diodes 6 and 7. As a result, the capacitor 9 is charged with a charging voltage level of $V_2$ as shown in FIG. 4.

The ignition signal generating circuit 16 generates the ignition signal $S_2$ in response to the ignition timing of the internal combustion engine. In response to the ignition circuit $S_2$, the trigger signal 17 transmits a trigger signal to the gate terminal of the thyristor 11. When the thyristor 11 is thus-triggered, the charge, which has been stored in the capacitor 8, is discharged via the primary coil of the ignition coil 10 and the thyristor 11. On the other hand, the charge stored in the capacitor 9 is discharged via the inductor 13, the primary coil of the ignition coil 10 and the thyristor 11. As a result, the output voltage $V_3$ and the output current $I_3$ as shown in FIG. 4 are generated in the secondary coil of the ignition coil 10 so that the ignition plug 15 is ignited.

At this time, a discharge maintaining current flows from the primary coil of the ignition coil 10 via the diode 14 and the inductor 13. As a result, discharge is maintained in the ignition plug 15 for only time $\Delta t_2$. According to this embodiment, time $\Delta t_3$ in which the signal $S_1$ transmitted from the oscillating circuit 2 turns on the transistor via the drive circuit 3 is made to be longer than the time $\Delta t_2$ in which the ignition plug 15 maintains its discharge operation.

Figure 4:
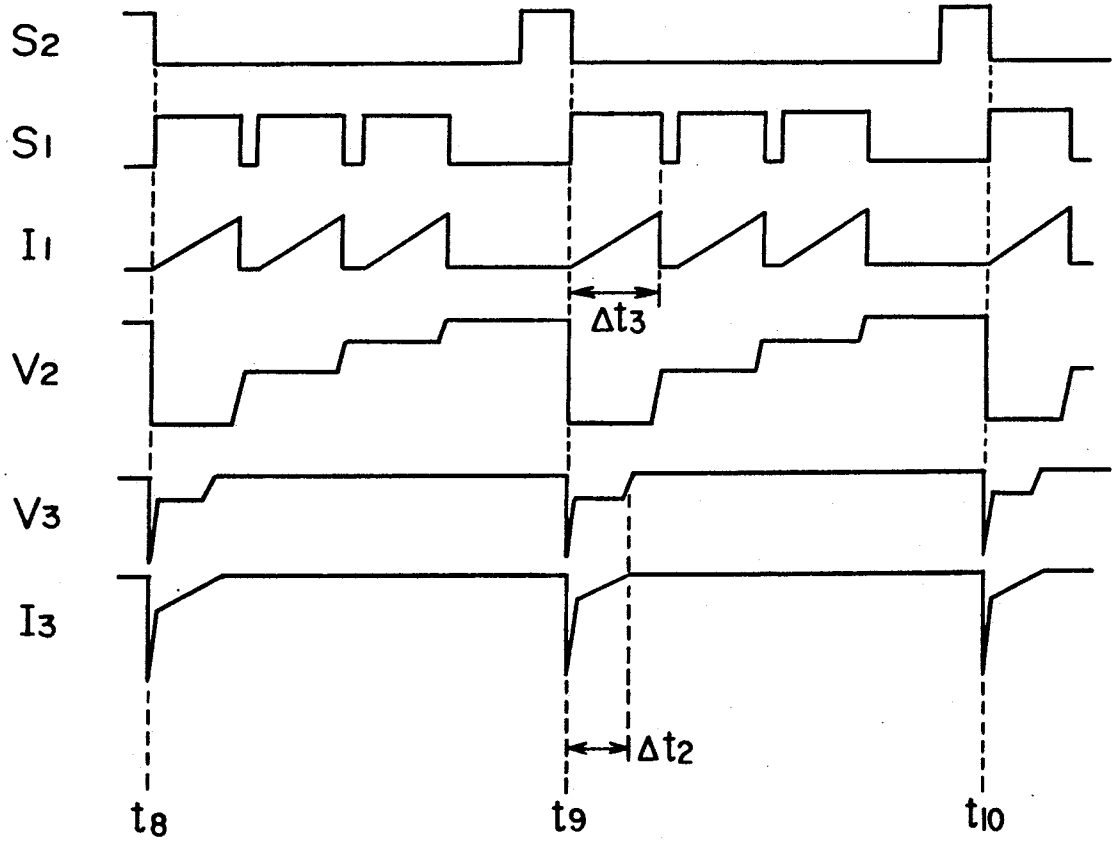
FIG. 4 is a timing chart which illustrates the operation of the second embodiment.

As is taken place at, for example, each time $t_8$, $t_9$ and $t_{10}$ shown in FIG. 4, the signal oscillating operation performed by the oscillating circuit 2 is commenced by the synchronizing circuit 20 whenever the ignition signal $S_2$ is generated by the ignition signal generating circuit 16. That is, the oscillating operation of the oscillating circuit 2 is commenced in synchronization with the discharge commencement of each of the capacitors 8 and 9. As described above, energy is not further supplied from the DC-DC converter to the capacitors 8 and 9 in the time $\Delta t_2$, in which the discharge is maintained because the time $\Delta t_3$, in which the transistor 4 is electrically turned on, is longer than the discharge maintaining time $\Delta t_2$. Therefore, the undesirable temporary halt of the discharge during the discharge operation of the ignition plug 15 due to the stop of the discharge maintaining current can be prevented.

Figure 5:
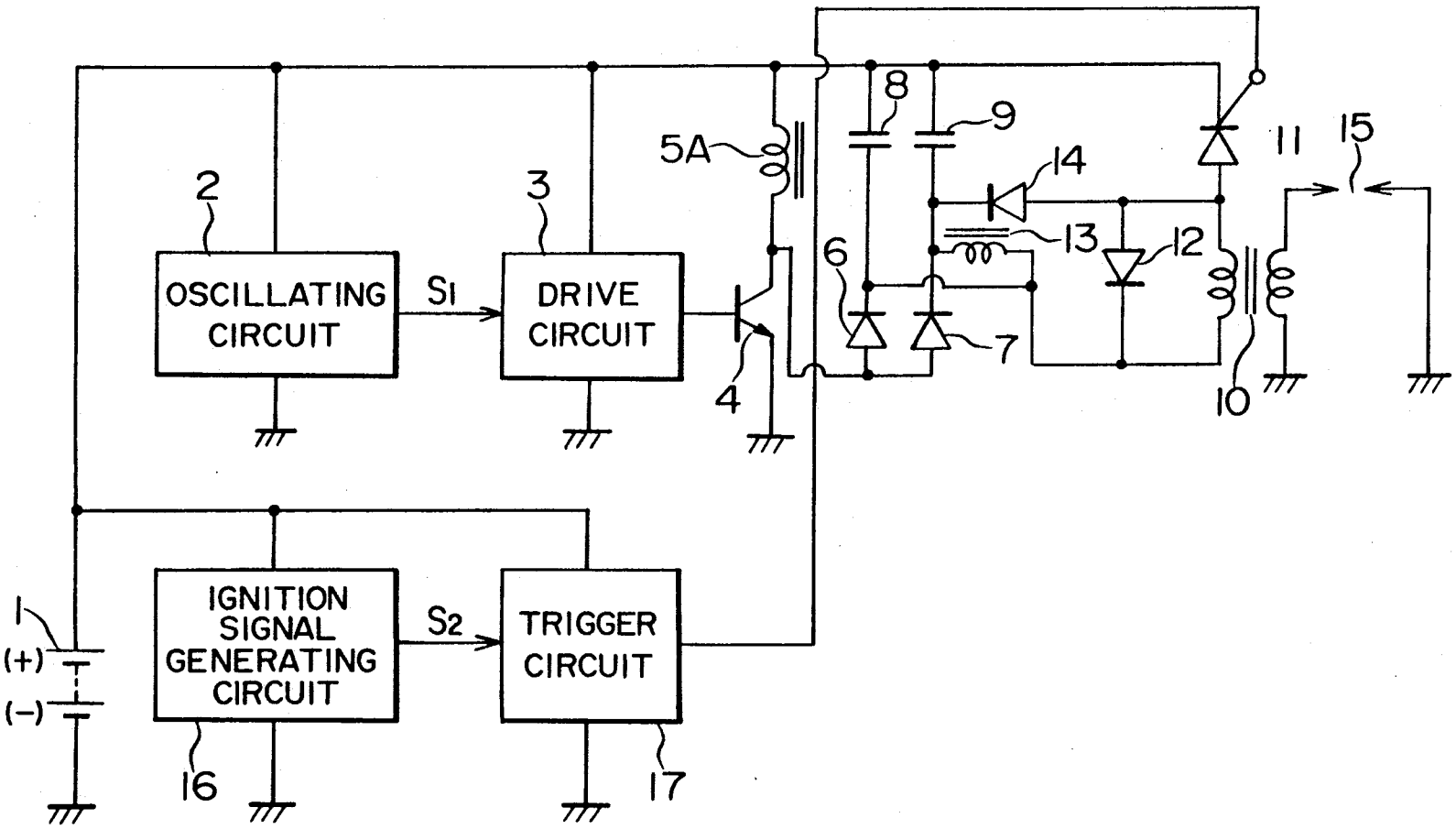
FIG. 5 is a block diagram which illustrates the structure of a third embodiment of the present invention.

The ignition device for an internal combustion engine according to a third embodiment of the present invention is shown in FIG. 5. The ignition device according to this embodiment is constituted by arranging the conventional ignition device shown in FIG. 8 in such a manner that: an inductor 5A is employed in place of the transformer 5; and the reference potential of each of the capacitors 8, 9 and the thyristor 11 is taken from the positive electrode of the battery 1.

That is, an end portion of the inductor 5A is connected to the collector of the transistor 4, while another end portion of the same is connected to the positive electrode of the battery 1. The anode of each of the diodes 6 and 7 is connected to the collector of the transistor 4. The cathode of each of the diodes 6 and 7 is, via capacitors 8 and 9, connected to the positive electrode of the battery 1. The anode of the thyristor 11 is connected to the primary coil of the ignition coil 10, while the cathode of the same is connected to the positive electrode of the battery 1.

Since the terminals serving as the reference potentials of the capacitors 8, 9 and the thyristor 11 are, as described above, respectively connected to the positive electrode of the battery 1, the introduction of an electric current into the inductor 5A is prevented during the time in which the thyristor 11 is being triggered.

Then, the operation of the third embodiment will now be described. In response to the signal $S_1$ transmitted from the oscillating circuit 2, the drive circuit 3 transmits a drive signal to the transistor 4. As a result, the transistor 4 is driven so that the inductor 5A is electrically turned on/off. The energy generated in the inductor 5A at this time is stored in the capacitors 8 and 9 via the diodes 6 and 7.

The ignition signal generating circuit 16 generates the ignition signal $S_2$ in synchronization with the timing of the internal combustion engine. In response to the ignition signal $S_2$, a trigger signal is transmitted from the trigger circuit 17 to the gate terminal of the thyristor 11. When the thyristor 11 is triggered, the charge, which has been stored in the capacitor 8, is discharged via the primary coil of the ignition coil 10 and the thyristor 11. On the other hand, the charge stored in the capacitor 9 is discharged via the inductor 13, the primary coil of the ignition coil 10 and the thyristor 11. As a result, high voltage is generated in the secondary coil of the ignition coil 10 so that the ignition plug 15 is ignited.

Since the ignition device according to the third embodiment is arranged in such a manner that the inductor 5A is used in place of the DC-DC converter, the size of the ignition device can be reduced and the charging efficiency can be improved.

What is claimed is:

1. An ignition device for an internal combustion engine comprising:

a DC power source;

conversion means for raising the voltage of said DC power source to a predetermined voltage;

charge storing means arranged to be charged with the output from said conversion means;

an ignition coil;

ignition signal generating means for generating an ignition signal in synchronization with the rotation of said internal combustion engine;

switching means which is switched on in response to said ignition signal generated by said ignition signal generating means to discharge a charge stored in said charge storing means through said ignition coil; and control means for stopping the operation of said conversion means during a period in which said ignition signal is being transmitted from said ignition signal generating means, wherein said conversion means includes an oscillating circuit, and a drive circuit for amplifying an output signal transmitted from said oscillating circuit, and wherein said control means includes a detection circuit for detecting an output of said ignition signal from said ignition signal generating means, and a coincidence circuit responsive to an output from said oscillating circuit and an output from said detection circuit for controlling said drive circuit.

2. An ignition device for an internal combustion engine according to claim 1, wherein said conversion means further comprises a switching device operated in response to an output signal transmitted from said drive circuit and a transformer connected to said DC power source and electrically turned on/off in accordance with the operation of said switching device.

3. An ignition device for an internal combustion engine according to claim 1 wherein said switching means comprises a thyristor.

4. An ignition device for an internal combustion engine according to claim 2, wherein said coincidence circuit comprises an AND gate.

5. An ignition device for an internal combustion engine according claim 2 wherein said charge storing means include a capacitor connected to said transformer.

6. An ignition device for an internal combustion engine comprising:

a DC power source;

conversion means for raising the voltage of said DC power source to a predetermined voltage;

charge storing means arranged to be charged with the output from said conversion means;

an ignition coil;

ignition signal generating means for generating an ignition signal in synchronization with the rotation of said internal combustion engine;

switching means which is switched on in response to said ignition signal generated by said ignition signal generating means to discharge a charge stored in said charge storing means through said ignition coil;

discharge maintaining means for passing a discharge current through said ignition coil for a predetermined time period after the discharge of a charge stored in said charge storing means has been completed; and control means for causing said conversion means to commence its operation in synchronization with said ignition signal generated by said ignition signal generating means.

7. An ignition device for an internal combustion engine according claim 6 wherein said conversion means includes an oscillating circuit, a drive circuit for amplifying an output signal transmitted from said oscillating circuit, a switching device operated in response to an output signal transmitted from said drive circuit and a transformer which is connected to said DC power source and which is electrically turned on/off in accordance with the operation of said switching device.

8. An ignition device for an internal combustion engine according claim 6 wherein said switching means comprises a thyristor.

9. An ignition device for an internal combustion engine according claim 7 wherein said charge storing means includes a first capacitor and a second capacitor respectively connected to said transformer.

10. An ignition device for an internal combustion engine according claim 9 wherein said discharge maintaining means includes an inductor which is connected to a portion between said second capacitor and said ignition coil.

11. An ignition device for an internal combustion engine comprising:

a DC power source;

a first inductor for raising the voltage of said DC power source to a predetermined voltage;

charge storing means arranged to be charged with the voltage raised by said first inductor;

an ignition coil;

ignition signal generating means for generating an ignition signal in synchronization with the rotation of said internal combustion engine;

switching means which is switched on in response to said ignition signal generated by said ignition signal generating means to discharge a charge stored in said charge storing means through said ignition coil; and discharge maintaining means for passing a discharge current through said ignition coil for a predetermined time period after the discharge of a charge stored in said charge storing means has been completed, wherein the reference potential of each of said charge storing means and said switching means is taken from the positive electrode of said DC power source.

12. An ignition device for an internal combustion engine according claim 11 wherein said switching means comprises a thyristor.

13. An ignition device for an internal combustion engine according claim 11 wherein said charge storing means includes a first capacitor and a second capacitor respectively connected to said first inductor.

14. An ignition device for an internal combustion engine according claim 13 wherein said discharge maintaining means includes a second inductor which is connected to a portion between said second capacitor and said ignition coil.

* * * * *